US011067937B2

(12) United States Patent
Tamura

(10) Patent No.: US 11,067,937 B2
(45) Date of Patent: Jul. 20, 2021

(54) IMAGE FORMING APPARATUS

(71) Applicant: KYOCERA Document Solutions Inc., Osaka (JP)

(72) Inventor: Yoshiaki Tamura, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/995,676

(22) Filed: Aug. 17, 2020

(65) Prior Publication Data

US 2021/0055684 A1 Feb. 25, 2021

(30) Foreign Application Priority Data

Aug. 20, 2019 (JP) ..... JP2019-150609

(51) Int. Cl.
*G03G 15/00* (2006.01)

(52) U.S. Cl.
CPC ..... *G03G 15/80* (2013.01)

(58) Field of Classification Search
CPC ..... G03G 15/80
See application file for complete search history.

(56) References Cited

U.S. PATENT DOCUMENTS

2006/0028661 A1 2/2006 Uruma ..... 358/1.6
2009/0094386 A1* 4/2009 Wang ..... G06F 1/3203 710/10

FOREIGN PATENT DOCUMENTS

JP 2006-72972 A 3/2006

* cited by examiner

*Primary Examiner* — G. M. A Hyder
(74) *Attorney, Agent, or Firm* — Stein IP, LLC

(57) ABSTRACT

An image forming apparatus includes a power switch, a power supply circuit, a power supply control unit, and a main control unit that sends a control signal to the power supply control unit and allows the power supply control unit to perform the power supply process based on the control signal. The power supply control unit starts to count pressing time as an elapsed time while the power switch is kept pressed. If the pressing time reaches a predetermined time without a change in the control signal, the power supply control unit forcibly starts a power shutdown process. If the control signal changes before the pressing time reaches the predetermined time, the power supply control unit starts the power shutdown process after receiving from the main control unit the control signal requesting for the power shutdown process.

3 Claims, 4 Drawing Sheets

IMAGE FORMING APPARATUS

INCORPORATION BY REFERENCE

This application is based upon and claims the benefit of priority from the corresponding Japanese Patent Application No. 2019-150609 filed Aug. 20, 2019, the entire contents of which are hereby incorporated by reference.

BACKGROUND

The present disclosure relates to an image forming apparatus equipped with a power switch.

Conventionally, there is known an image forming apparatus equipped with a power switch.

For instance, the conventional image forming apparatus is equipped with a main control unit that controls the entire image forming apparatus. The main control unit counts time while the power switch is kept pressed, and when the counted time becomes a predetermined time or more, it is put into a shutdown mode. In other words, the main control unit is put into a shutdown mode when it detects that a long press operation of the power switch is performed. Then, the main control unit performs a control process related to shutdown.

SUMMARY

An image forming apparatus of the present disclosure includes a power switch, a power supply circuit, a power supply control unit, and a main control unit. The power switch is operated by a user. The power supply circuit is connected to a power supplied unit that works with power supplied, and supplies power to the power supplied unit. The power supply control unit detects pressing of the power switch, and performs a power supply process for controlling the power supply circuit. The main control unit sends a control signal to the power supply control unit and allows the power supply control unit to perform the power supply process based on the control signal. When detecting the pressing of the power switch, the power supply control unit starts to count pressing time that is an elapsed time while the power switch is kept pressed. If the pressing time reaches a predetermined time without a change in the control signal, the power supply control unit forcibly starts a power shutdown process that is the power supply process for turning off the power supply circuit. If the control signal changes before the pressing time reaches the predetermined time, the power supply control unit starts the power shutdown process after receiving from the main control unit the control signal requesting for the power shutdown process.

DETAILED DESCRIPTION

<Structure of Image Forming Apparatus>

Figure 1:
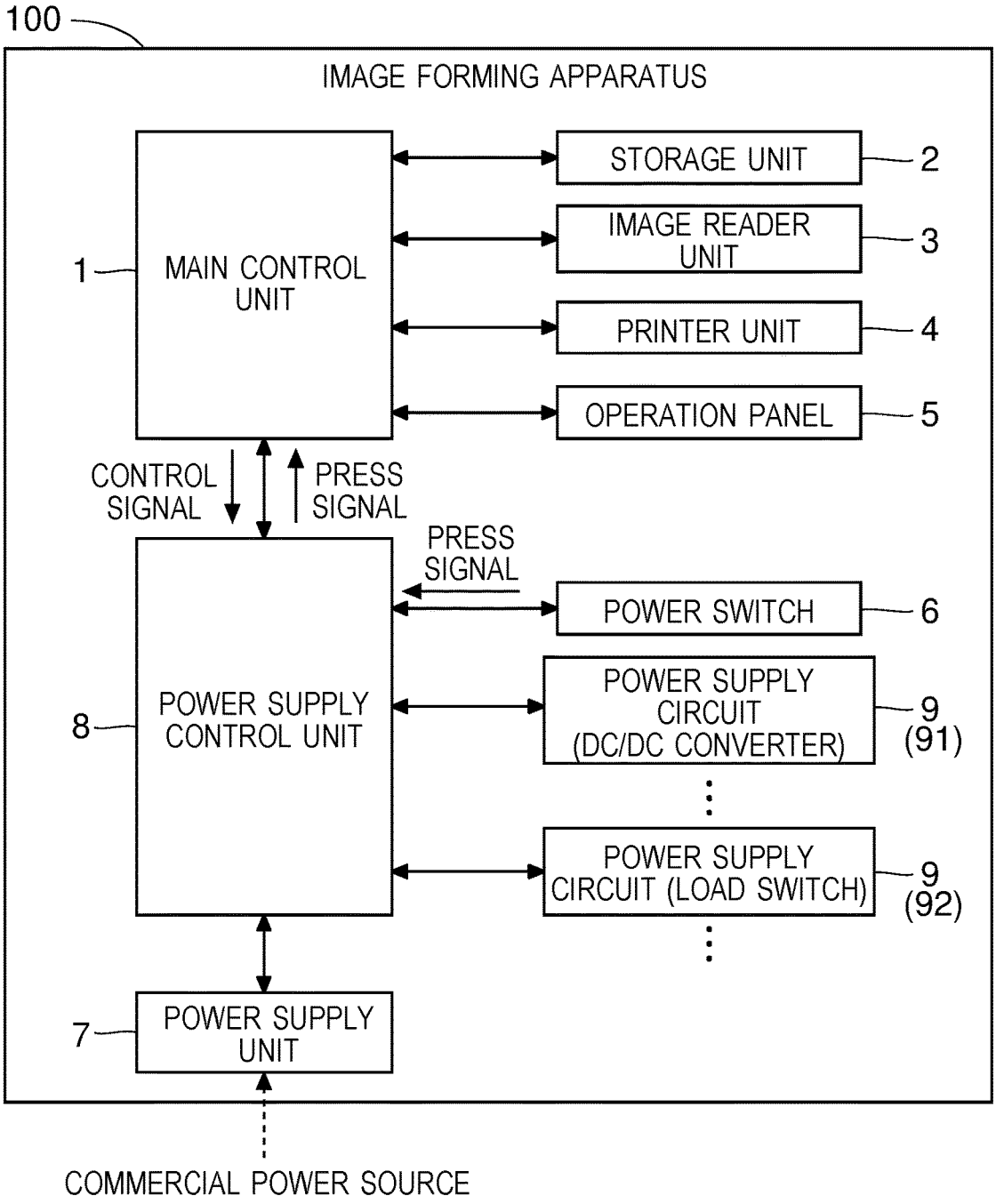
FIG. 1 is a block diagram illustrating a structure of an image forming apparatus according to one embodiment of the present disclosure.

As illustrated in FIG. 1, an image forming apparatus 100 of this embodiment includes a main control unit 1 and a storage unit 2. The main control unit 1 includes a CPU. The main control unit 1 controls the entire image forming apparatus 100 on the basis of a control program and control data. The storage unit 2 includes storage devices such as a ROM, a RAM, and a flash ROM. The storage unit 2 is connected to the main control unit 1. The main control unit 1 writes information into the storage unit 2 and reads information from the storage unit 2. The control program and the control data are stored in the storage unit 2.

Further, the image forming apparatus 100 includes an image reader unit 3. The image reader unit 3 includes a read control unit. The read control unit is connected to the main control unit 1. The read control unit receives an instruction from the main control unit 1 and controls reading operation of the image reader unit 3.

The image reader unit 3 reads a document and generates read data. The image reader unit 3 includes a light source and an image sensor. The light source emits light to the document. The image sensor receives reflection light reflected by the document and performs photoelectric conversion thereof.

Further, the image forming apparatus 100 includes a printer unit 4. The printer unit 4 includes an engine control unit. The engine control unit is connected to the main control unit 1. The engine control unit receives an instruction from the main control unit 1 and controls printing operation of the printer unit 4.

The printer unit 4 conveys a paper sheet and prints an image on the paper sheet under conveyance. The printer unit 4 includes a photosensitive drum, a transfer roller, a charging device, an exposing device, and a developing device. Further, the printer unit 4 includes a fixing device. The photosensitive drum carries a toner image. The transfer roller is pressed to contact the photosensitive drum so that a transfer nip is formed between the transfer roller and the photosensitive drum. The charging device charges a circumferential surface of the photosensitive drum. The exposing device forms an electrostatic latent image on the circumferential surface of the photosensitive drum. The developing device develops the electrostatic latent image formed on the circumferential surface of the photosensitive drum into a toner image.

The paper sheet under conveyance passes through the transfer nip. When the paper sheet passes through the transfer nip, the toner image on the circumferential surface of the photosensitive drum is transferred (printed) onto the paper sheet. The paper sheet with the transferred toner image is conveyed to the fixing device. The fixing device fixes the toner image to the paper sheet.

Further, the image forming apparatus 100 includes an operation panel 5. The operation panel 5 displays various screens and receives operations by a user. The operation panel 5 is equipped with a touch screen and hardware buttons. The touch screen includes a display panel and a touch panel. The operation panel 5 is connected to the main control unit 1. The main control unit 1 controls a display operation of the operation panel 5. Further, the main control unit 1 detects an operation performed on the operation panel 5.

Here, the image forming apparatus 100 includes a power switch 6. For instance, the power switch 6 is disposed on the operation panel 5. The power switch 6 is operated by the user. In order to shut down the image forming apparatus 100, the user presses the power switch 6.

Further, the image forming apparatus 100 includes a power supply unit 7. The power supply unit 7 includes a low voltage power supply substrate. The power supply unit 7 converts the power supplied from a commercial power source to generate a DC voltage. When a power cable of the image forming apparatus 100 is connected to an outlet, electric power is supplied from the commercial power source to the power supply unit 7.

Further, the image forming apparatus 100 includes a power supply control unit 8. For instance, the power supply control unit 8 is a microcomputer of a small scale and a low cost. The power supply control unit 8 is supplied with a DC voltage generated by the power supply unit 7. For instance, when the power cable of the image forming apparatus 100 is connected to an outlet, the power supply unit 7 supplies a DC voltage to the power supply control unit 8, and a predetermined signal is input from the power supply unit 7 to the power supply control unit 8.

The power supply control unit 8 detects an operation performed on the power switch 6. When the power switch 6 is pressed, a press signal indicating that the power switch 6 is pressed is input to the power supply control unit 8. When the press signal is input, the power supply control unit 8 detects that the power switch 6 is pressed. The press signal is also input to the main control unit 1 via the power supply control unit 8. When the press signal is input, the main control unit 1 detects that the power switch 6 is pressed.

The power supply control unit 8 is connected to a plurality of power supply circuits 9. The power supply control unit 8 performs a power supply process (sequence control) of controlling on and off of the plurality of power supply circuits 9. As the power supply circuit 9 controlled by the power supply control unit 8, there are a DC/DC converter 91, a load switch 92, and the like. For convenience sake, FIG. 1 shows one DC/DC converter 91 and one load switch 92.

The power supply control unit 8 is connected to the main control unit 1 via a plurality of signal lines. The main control unit 1 sends various requests (signals) to the power supply control unit 8 via the plurality of signal lines. The main control unit 1 sends to the power supply control unit 8 a control signal related to the power supply process (sequence control). The main control unit 1 sends the control signal to the power supply control unit 8 so as to allow the power supply control unit 8 to perform the power supply process based on the sent control signal.

There are a plurality of the power supply processes performed by the power supply control unit 8. The power supply control unit 8 detects the control signal from the main control unit 1 (signal levels of the signal lines) and recognizes the requested power supply process out of the plurality of power supply processes. When receiving the request for the power supply process, the power supply control unit 8 sequentially turns on or off two or more power supply circuits 9 (the power supply circuits 9 to be turned on or off in the requested power supply process).

Figure 2:
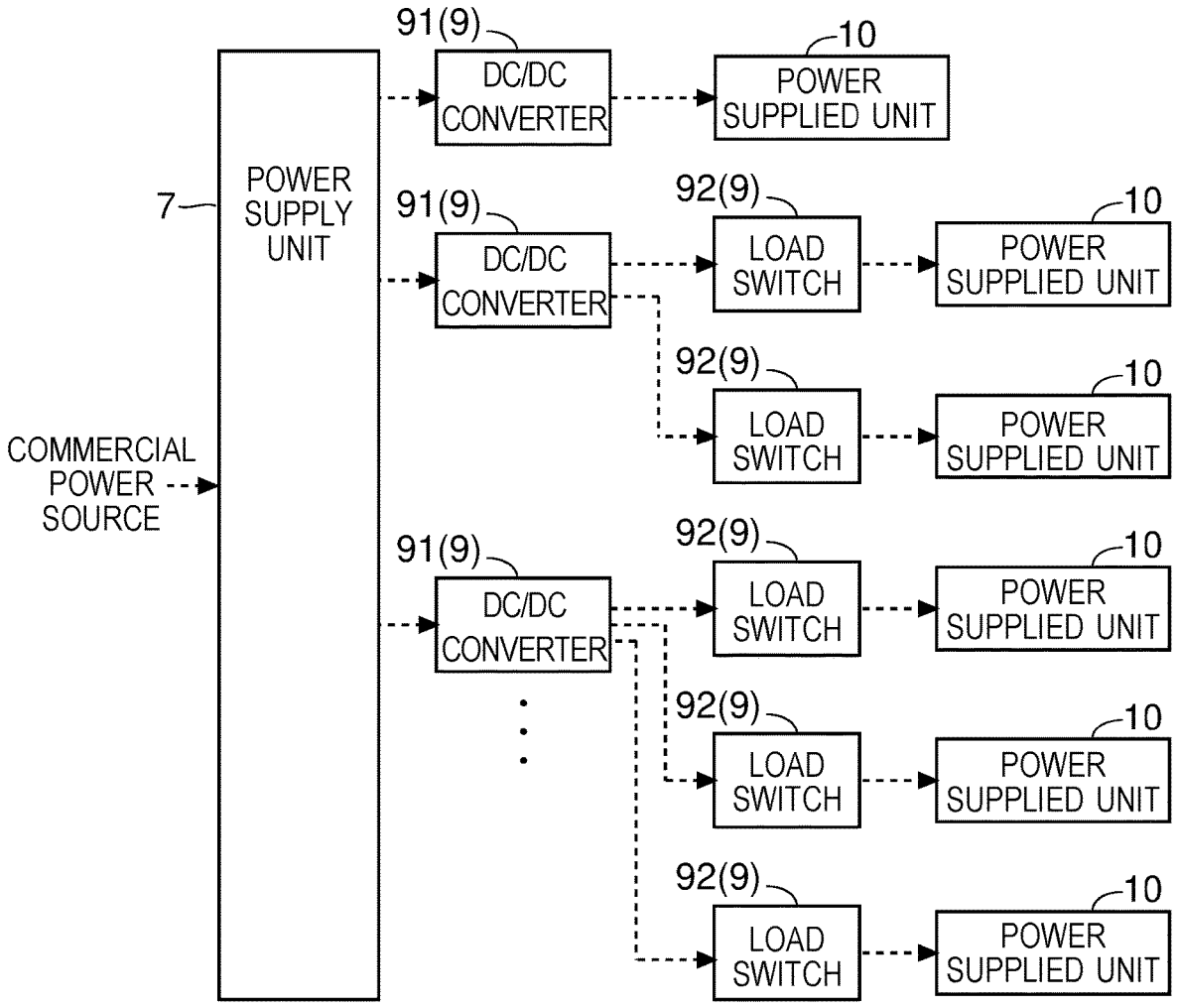
FIG. 2 is a diagram illustrating a power supply system of the image forming apparatus according to one embodiment of the present disclosure.

The power supply circuit 9 is connected to a power supplied unit 10 that works with power supplied, as illustrated in FIG. 2. The power supply circuit 9 supplies power to the power supplied unit 10. In FIG. 2, power supply lines are shown by broken line arrows. Various devices (such as the CPU, memories, sensors, motors, the display panel, and the touch panel) disposed in the individual units such as the main control unit 1, the storage unit 2, the image reader unit 3, the printer unit 4, and the operation panel 5 correspond to the power supplied units 10.

For instance, the DC/DC converter 91 supplies power to the power supplied unit 10 via the load switch 92. There is also the power supplied unit 10 that is supplied with power directly from the DC/DC converter 91 without the load switch 92.

When the power supply circuit 9 in OFF state is turned on, it starts power supply to the power supplied unit 10 connected to the power supply circuit 9. When the power supply circuit 9 in ON state is turned off, it stops power supply to the power supplied unit 10 connected to the power supply circuit 9.

<Power Supply Process>

When the power supply from the power supply unit 7 is started, the power supply control unit 8 performs a start process for starting the main control unit 1, as the power supply process. Until the start process is completed, the main control unit 1 does not send the control signal to the power supply control unit 8.

When the main control unit 1 normally starts (When the start process is normally completed), the main control unit 1 sends to the power supply control unit 8 the control signal requesting for a ready process (one of the power supply processes). The power supply control unit 8 sequentially turns on the power supply circuits 9 to be turned on in the ready process. For instance, all the power supply circuits 9 are turned on in the ready process. In other words, all the power supplied units 10 are supplied with power. In this way, the image forming apparatus 100 becomes a ready state (a standby state in which jobs can be performed).

The main control unit 1 determines whether or not a predetermined sleep shift condition is satisfied after the image forming apparatus 100 has become the ready state. For instance, the main control unit 1 counts unused time that is an elapsed time during which the image forming apparatus 100 is not used, and when the unused time reaches a predetermined upper limit time, it determines that the sleep shift condition is satisfied. When the sleep shift condition is satisfied, the main control unit 1 sends to the power supply control unit 8 the control signal requesting for a sleep shift process (one of the power supply processes).

When receiving the control signal requesting for the sleep shift process, the power supply control unit 8 sequentially turns off the power supply circuits 9 to be turned off in the sleep shift process. As the sleep shift process is performed, the image forming apparatus 100 is shifted to a sleep state. For instance, power supply to the image reader unit 3 and the printer unit 4 is stopped. Further, power supply to the display panel of the operation panel 5 is stopped. When the image forming apparatus 100 is shifted to the sleep state, power consumption of the image forming apparatus 100 becomes smaller than in the ready state of the image forming apparatus 100.

After the image forming apparatus 100 is shifted to the sleep state, the main control unit 1 determines whether or not a predetermined sleep return condition is satisfied. For instance, if the main control unit 1 detects that an operation is made on the operation panel 5 in the sleep state of the image forming apparatus 100, it determines that the sleep return condition is satisfied. When the sleep return condition is satisfied, the main control unit 1 sends to the power supply control unit 8 the control signal requesting for a sleep return process (one of the power supply processes).

When receiving the control signal requesting for the sleep return process, the power supply control unit 8 sequentially turns on the power supply circuits 9 to be turned on in the sleep return process. In this case, power supply to the image reader unit 3 and the printer unit 4 is restarted. Further, power supply to the display panel of the operation panel 5 is restarted. In this way, the image forming apparatus 100 returns to the ready state.

Note that the power supply process described above is an example. In addition to the power supply process described above, other power supply process may be performed.

<Shutdown>

During startup of the image forming apparatus 100, the main control unit 1 may become an abnormal state (such as hung-up). When the main control unit 1 becomes an abnormal state, the image forming apparatus 100 does not work even if the user makes an operation on the operation panel 5. Further, a display screen of the operation panel 5 does not change. In this state, the abnormal state of the main control unit 1 can be canceled by restarting the image forming apparatus 100.

Therefore in this embodiment, a forced shutdown operation is received from the user. A long press operation of the power switch 6 (an operation of continuously pressing the power switch 6) is received as the forced shutdown operation. When the image forming apparatus 100 does not work even if the operation panel 5 is operated (When the main control unit 1 is in the abnormal state), the user makes the forced shutdown operation, and then the image forming apparatus 100 is forcibly shutdown.

The power supply control unit 8 determines whether or not the forced shutdown operation is made on the power switch 6. Specifically, when the power supply control unit 8 detects the pressing of the power switch 6, it starts to count pressing time that is an elapsed time during which the power switch 6 is kept pressed. Further, when the counted pressing time reaches a predetermined time, the power supply control unit 8 determines that the forced shutdown operation is made. The predetermined time is 10 seconds, for example.

When the power supply control unit 8 determines that the forced shutdown operation is made, it forcibly performs the power shutdown process (one of the power supply processes). In other words, the power supply control unit 8 performs the power shutdown process even if it has not received from the main control unit 1 the control signal requesting for the power shutdown process.

In the power shutdown process, all the power supply circuits 9 are turned off. In this way, power supply to all the power supplied units 10 including the main control unit 1 is stopped. As a result, the image forming apparatus 100 becomes a state before the start process.

Note that after the image forming apparatus 100 becomes the state before the start process, the power supply control unit 8 determines whether or not the power switch 6 is pressed. In this case, the main control unit 1 is not supplied with power. Therefore, only the power supply control unit 8 determines whether or not the power switch 6 is pressed.

When the power supply control unit 8 detects the pressing of the power switch 6, it performs the start process. In this way, the main control unit 1 starts. Then, the main control unit 1 outputs to the power supply control unit 8 the control signal requesting for the ready process. When receiving the control signal, the power supply control unit 8 performs the ready process.

Here, the user may make a long press of the power switch 6 when the main control unit 1 is in a normal state. If the long press of the power switch 6 is made though the main control unit 1 is in the normal state, the pressing time may reach the predetermined time while the main control unit 1 is writing data to the flash ROM, for example. In this case, if the power shutdown process is forcibly performed because the pressing time reaches the predetermined time, an inconvenience such as corruption of data under writing may occur.

In order to prevent such an inconvenience, even if the long press of the power switch 6 is made, if the main control unit 1 is in the normal state, the power supply control unit 8 does not perform the forcible power shutdown process. If the main control unit 1 is in the normal state, the power supply control unit 8 performs the power shutdown process after receiving from the main control unit 1 the control signal requesting for the power shutdown process.

Figure 3:
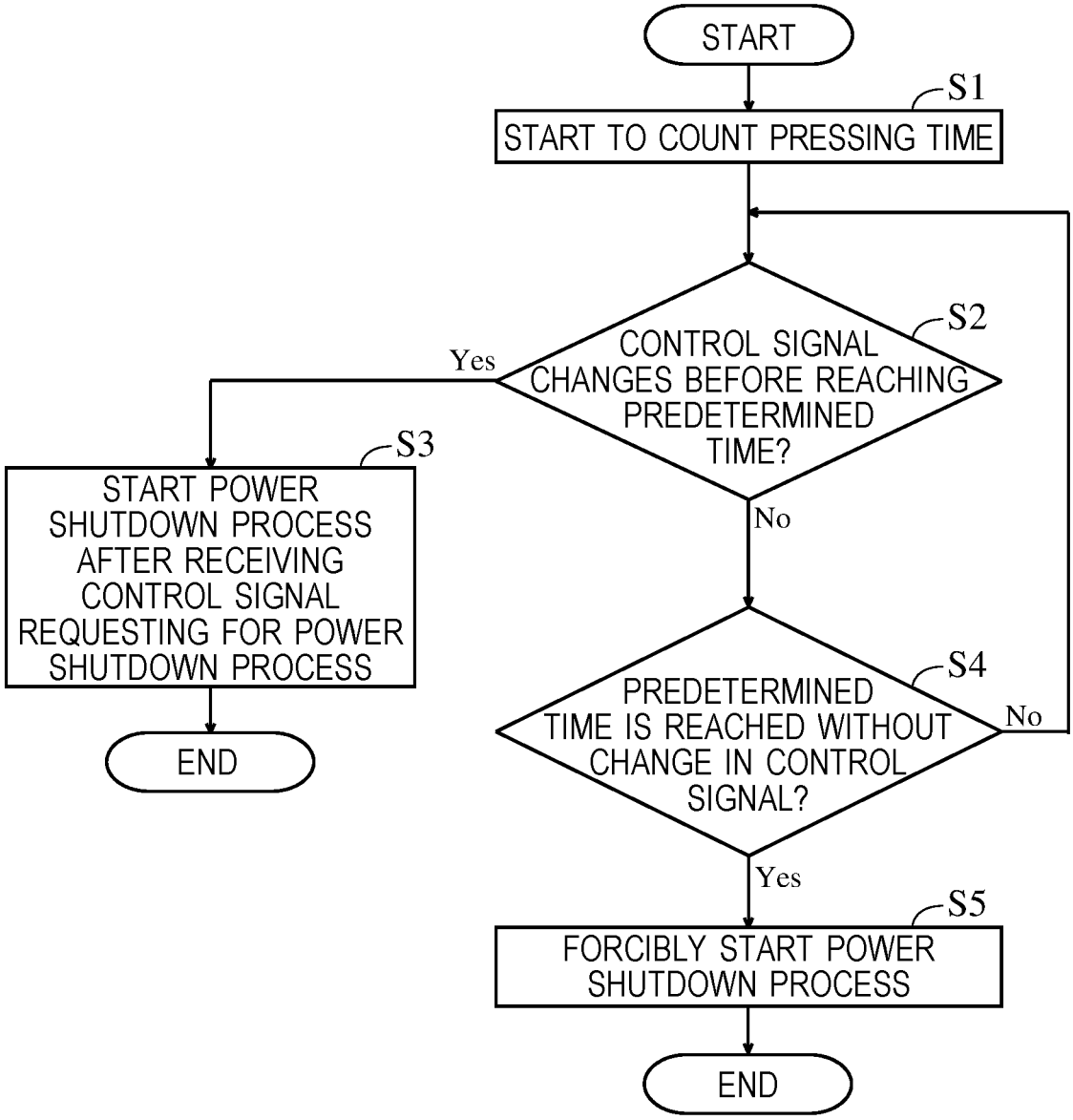
FIG. 3 is a flowchart illustrating a flow of a process performed by a power supply control unit of the image forming apparatus according to one embodiment of the present disclosure.

Specific description is added below with reference to a flowchart shown in FIG. 3. The flowchart shown in FIG. 3 starts when the power supply control unit 8 detects the pressing of the power switch 6. When the power switch 6 is pressed, the press signal indicating that the power switch 6 is pressed is input to the power supply control unit 8. If the long press of the power switch 6 is being made, the press signal is continuously input to the power supply control unit 8.

The press signal is input to the main control unit 1, too. If the main control unit 1 is in the normal state, the main control unit 1 detects the pressing of the power switch 6. On the contrary, if the main control unit 1 is in the abnormal state, the main control unit 1 does not detect pressing of the power switch 6.

In Step S1, the power supply control unit 8 starts to count the pressing time. Note that when the power supply control unit 8 detects that pressing of the power switch 6 is released before the pressing time reaches the predetermined time, it does not perform the forcible power shutdown process.

In Step S2, the power supply control unit 8 determines whether or not the control signal has changed before the pressing time reaches the predetermined time. In other words, the power supply control unit 8 determines whether or not a signal level of any of the signal lines connecting the main control unit 1 and the power supply control unit 8 has changed. If the power supply control unit 8 determines that the control signal has changed before the pressing time reaches the predetermined time, the process flow proceeds to Step S3.

Here, if the power switch 6 is pressed during startup of the image forming apparatus 100, and if the main control unit 1 is in the normal state, the main control unit 1 detects the pressing of the power switch 6. When the main control unit 1 detects the pressing of the power switch 6, it performs a predetermined preparation process for normal shutdown of the image forming apparatus 100. For instance, data on the RAM are written to the flash ROM in the preparation process. Further, when the main control unit 1 detects the pressing of the power switch 6, it sends to the power supply control unit 8 the control signal indicating that the pressing of the power switch 6 is detected before a predetermined time elapses after the pressing of the power switch 6 is detected. In this way, if the main control unit 1 is in the normal state, the control signal changes (a signal level of any of the signal lines connecting the main control unit 1 and the power supply control unit 8 changes) before the pressing time reaches the predetermined time. In other words, if the main control unit 1 is in the normal state, the process flow proceeds from Step S2 to Step S3.

Note that if the control signal changes before the pressing time reaches the predetermined time, the power supply control unit 8 finishes counting the pressing time and resets the pressing time. If the control signal changes before the pressing time reaches the predetermined time, it means that the main control unit 1 is in the normal state. Therefore, after resetting the pressing time, if the control signal changes, the power supply control unit 8 performs the power supply process based on the changed control signal.

In Step S3, the power supply control unit 8 receives from the main control unit 1 the control signal requesting for the power shutdown process, and starts the power shutdown process. In other words, the power supply control unit 8 does not perform the forcible power shutdown process.

Here, when the main control unit 1 detects the pressing of the power switch 6 during startup of the image forming apparatus 100 (when the main control unit 1 is in the normal state), it sends to the power supply control unit 8 the control signal requesting for the power shutdown process after the preparation process is completed. Therefore, if the main control unit 1 is in the normal state, the power supply control unit 8 starts the power shutdown process, after the main control unit 1 completes the preparation process.

Figure 4:
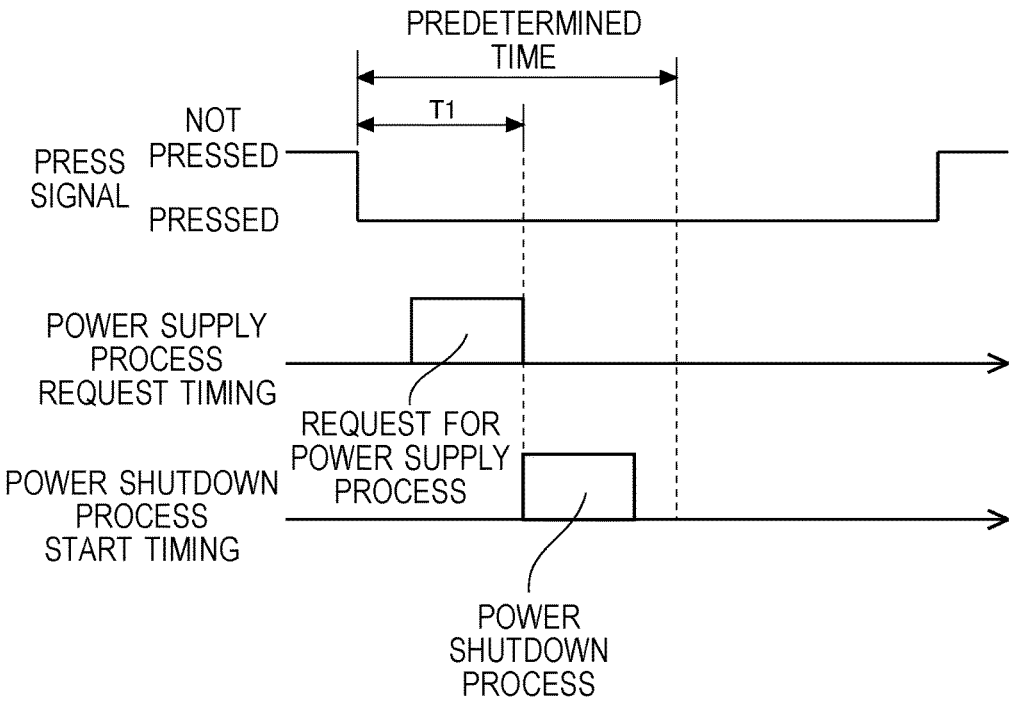
FIG. 4 is a chart illustrating a start timing of a power shutdown process performed by the power supply control unit of the image forming apparatus according to one embodiment of the present disclosure.

For instance, as illustrated in FIG. 4, if processing time of the preparation process (denoted by T1 in FIG. 4) is less than the predetermined time, the main control unit 1 sends to the power supply control unit 8 the control signal requesting for the power shutdown process before the pressing time reaches the predetermined time (when the preparation process is completed). In this case, the power shutdown process is started before the pressing time reaches the predetermined time. Note that the processing time of the preparation process may be more than the predetermined time.

With reference to FIG. 3 again, in Step S2, if the power supply control unit 8 determines that the control signal is not changed, the process flow proceeds to Step S4. In Step S4, the power supply control unit 8 determines whether or not the pressing time has reached the predetermined time without a change in the control signal. If the power supply control unit 8 determines that the pressing time has reached the predetermined time without a change in the control signal, the process flow proceeds to Step S5. On the contrary, if the power supply control unit 8 determines that the control signal has not changed and that the pressing time has not reached the predetermined time, the process flow proceeds to Step S2.

In Step S5, the power supply control unit 8 forcibly starts the power shutdown process. If the pressing time has reached the predetermined time without a change in the control signal, it means that the main control unit 1 is in the abnormal state. In other words, the main control unit 1 does not send to the power supply control unit 8 the control signal requesting for the power shutdown process. Therefore, the power shutdown process is forcibly started.

Figure 5:
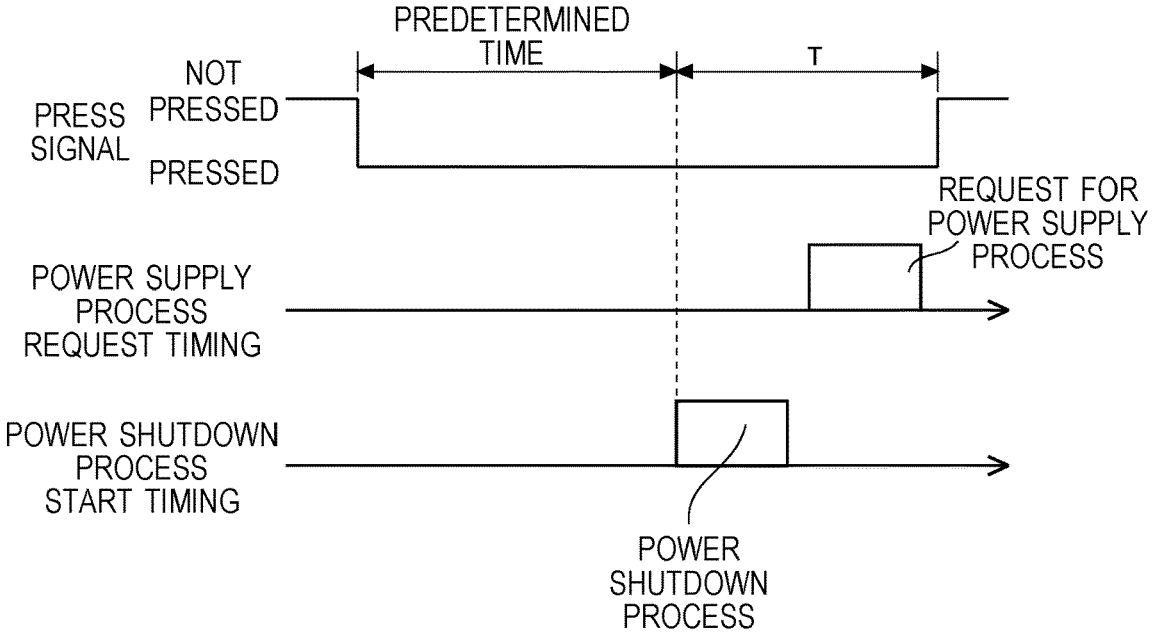
FIG. 5 is a chart illustrating a start timing of the power shutdown process performed by the power supply control unit of the image forming apparatus according to one embodiment of the present disclosure.

If the pressing time has reached the predetermined time without a change in the control signal, as illustrated in FIG. 5, the power shutdown process is forcibly started when the pressing time reaches the predetermined time. In this way, even if the main control unit 1 is in the abnormal state, the image forming apparatus 100 can be shut down.

Here, when the power shutdown process is performed, power supply to the main control unit 1 is stopped. As a result, there may occur a situation in which the control signal is changed (a signal level of any of the signal lines connecting the main control unit 1 and the power supply control unit 8 changes). In this case, the following inconvenience may occur.

For instance, it is supposed that the power switch 6 is kept pressed after the power shutdown process is completed. In this example, during pressing of the power switch 6, if signal levels of the signal lines change to levels corresponding to the control signal requesting for the ready process, the image forming apparatus 100 starts despite a user's intention.

Therefore, as illustrated in FIG. 5, even if the control signal changes in the period (denoted by T in FIG. 5) from the forcible start of the power shutdown process until the pressing of the power switch 6 is released, the power supply control unit 8 does not perform the power supply process based on the changed control signal.

As described above, the image forming apparatus 100 of this embodiment includes the power switch 6 to be operated by a user, the power supply circuit 9 connected to the power supplied unit 10 that works with power supplied, so as to supply power to the power supplied unit 10, the power supply control unit 8 that detects the pressing of the power switch 6 and performs the power supply process for controlling the power supply circuit 9, and the main control unit 1 that sends the control signal to the power supply control unit 8, so as to allow the power supply control unit 8 to perform the power supply process based on the control signal. The power supply control unit 8 starts counting the pressing time as an elapsed time during which the power switch 6 is kept pressed, when it detects the pressing of the power switch 6.

Here, even during startup of the image forming apparatus 100, if the main control unit 1 is in the abnormal state, the main control unit 1 does not work. Therefore, the control signal does not change (signal levels of the signal lines connecting the main control unit 1 and the power supply control unit 8 do not change). In other words, the control signal requesting for the power shutdown process is not sent from the main control unit 1 to the power supply control unit 8. Therefore, if the pressing time has reached the predetermined time without a change in the control signal, the power supply control unit 8 forcibly starts the power shutdown process that is the power supply process for turning off the power supply circuit 9.

On the contrary, if the main control unit 1 is in the normal state, when the power switch 6 is pressed, the main control unit 1 detects pressing of the power switch 6. In this case, the main control unit 1 sends to the power supply control unit 8 the control signal indicating that the pressing of the power switch 6 is detected. In other words, the control signal changes (a signal level of any of the signal lines connecting the main control unit 1 and the power supply control unit 8 changes). Then, the main control unit 1 sends to the power supply control unit 8 the control signal requesting for the power shutdown process, after the preparation process is completed. Therefore, if the control signal changes before the pressing time reaches the predetermined time, the power supply control unit 8 starts the power shutdown process after it receives from the main control unit 1 the control signal requesting for the power shutdown process.

In this way, it is possible to prevent the image forming apparatus 100 from being forcibly shut down though the main control unit 1 is in the normal state. In other words, if the main control unit 1 is in the normal state, the image forming apparatus 100 is shut down after the main control unit 1 completes the preparation process. As a result, it is possible to avoid an inconvenience such as corruption of data. On the contrary, if the main control unit 1 is in the abnormal state, the image forming apparatus 100 can be forcibly shut down.

Note that adopting a structure in which the power supply control unit 8 regularly monitors the main control unit 1 using a watchdog function, the power supply control unit 8 can recognize whether or not the main control unit 1 is in the abnormal state. However, this structure requires each of the main control unit 1 and the power supply control unit 8 to have a dedicated terminal. If the number of terminals is insufficient, it is necessary to add a terminal, which causes increase in cost. In this embodiment, the power supply control unit 8 recognizes a state of the main control unit 1 without using the watchdog function, and hence an increase in cost can be avoided.

Further, in this embodiment, as described above, after forcibly starting the power shutdown process until the pressing of the power switch 6 is released, even if the control signal changes, the power supply control unit 8 does not perform the power supply process based on the changed control signal. In this way, when the user performs the long press operation of the power switch 6 intentionally to shut down the image forming apparatus 100, it is possible to prevent occurrence of inconvenience that the image forming apparatus 100 restarts (the ready process is performed) because the long press operation is continued.

Further, in this embodiment, as described above, when the main control unit 1 detects the pressing of the power switch 6, it performs the preparation process to shut down the image forming apparatus 100, and then sends to the power supply control unit 8 the control signal requesting for the power shutdown process. In this way, it is possible to prevent occurrence of inconvenience such as corruption of data.

The embodiment disclosed in this specification is merely an example in every aspect and should not be interpreted as a limitation. The scope of the present disclosure is defined not by the above description of the embodiment but by the claims, and includes all modifications within the meaning and scope equivalent to the claims.

What is claimed is:

1. An image forming apparatus comprising:

a power switch to be operated by a user;

a power supply circuit connected to a power supplied unit that works with power supplied, so as to supply power to the power supplied unit;

a power supply control unit, which detects pressing of the power switch and performs a power supply process for controlling the power supply circuit; and a main control unit, which sends a control signal to the power supply control unit, so as to allow the power supply control unit to perform the power supply process based on the control signal, wherein when detecting the pressing of the power switch, the power supply control unit starts to count pressing time that is an elapsed time during which the power switch is kept pressed, if the pressing time reaches a predetermined time without a change in the control signal, the power supply control unit forcibly starts a power shutdown process that is the power supply process for turning off the power supply circuit, and if the control signal changes before the pressing time reaches the predetermined time, the power supply control unit starts the power shutdown process after receiving from the main control unit the control signal requesting for the power shutdown process.

2. The image forming apparatus according to claim 1, wherein after forcibly starting the power shutdown process until the pressing of the power switch is released, even if the control signal has changed, the power supply control unit does not perform the power supply process based on the changed control signal.

3. The image forming apparatus according to claim 1, wherein when detecting the pressing of the power switch, the main control unit performs a preparation process to shut down the image forming apparatus, and then sends to the power supply control unit the control signal requesting for the power shutdown process.

* * * * *